United States Patent [19]

Konnemann

[11] Patent Number: 4,707,050

[45] Date of Patent: Nov. 17, 1987

[54] EXTRA LOCKING ELEMENT FOR ROUND PLUGS

[75] Inventor: Alfred Konnemann, Wuppertal, Fed. Rep. of Germany

[73] Assignee: Grote & Hartmann GmbH & Co. KG, Fed. Rep. of Germany

[21] Appl. No.: 917,437

[22] Filed: Oct. 9, 1986

Related U.S. Application Data

[63] Continuation of Ser. No. 822,949, Jan. 27, 1986, abandoned, which is a continuation of Ser. No. 567,327, Dec. 30, 1983, abandoned.

[30] Foreign Application Priority Data

Jan. 28, 1983 [DE] Fed. Rep. of Germany ..... 3302824

[51] Int. Cl.[4] ..... H01R 13/40

[52] U.S. Cl. ..... 439/747; 439/851

[58] Field of Search ..... 339/217 S, 258 R, 258 P

[56] References Cited

U.S. PATENT DOCUMENTS

| | | | |
|---|---|---|---|
| 3,462,726 | 8/1969 | Stark et al. | 339/217 S |
| 3,613,052 | 10/1971 | Maltais | 339/217 S |
| 3,980,385 | 9/1976 | Hirokawa et al. | 339/217 S |

FOREIGN PATENT DOCUMENTS

| | | | |
|---|---|---|---|
| 2320079 | 4/1973 | Fed. Rep. of Germany . | |
| 2656920 | 6/1978 | Fed. Rep. of Germany | 339/217 S |
| 2149241 | 8/1972 | France . | |
| 2266329 | 10/1975 | France | 339/217 S |

*Primary Examiner*—Joseph H. McGlynn

*Attorney, Agent, or Firm*—Jones, Askew & Lunsford

[57] ABSTRACT

This invention concerns an extra locking element for a round plug. The round plug has a base part rolled in a cylindrical shape in cross section, connected to a contact area which extends to the front and a prong part or soldered part extending to the rear, optionally with stop spring arms in the contact area. There is least one stop edge in the casing of the cylindrical base part so that the stop edge runs across the longitudinal axis of the plug and projects radially outward beyond the base part.

9 Claims, 4 Drawing Figures

EXTRA LOCKING ELEMENT FOR ROUND PLUGS

This application is a continuation of application Ser. No. 822,949, filed 1-27-86, now abandoned, which is a continuation of application Ser. No. 567,327, filed Dec. 30, 1983, now abandoned.

BACKGROUND OF THE INVENTION

This invention concerns an extra locking element for round plugs. Such plugs may be in the form of plug connectors or receptacles which are made of a punched metal part and optionally may be equipped with overtravel.

Round plugs have a prong part or soldered part to which a cylindrical rolled base part is connected, and said base part is in turn connected either to spring arms with a plug receptacle or a plug pin.

The round plugs usually have stop spring arms which engage corresponding stop edges in a housing compartment after the plugs have been inserted into a housing compartment. If the round plugs are equipped with overtravel, then according to a recent proposal, the stop spring arms may be loacted on the overtravel.

In addition to these stop mechanisms, a plug boundary edge or a similar element may be located in the housing compartment so that a ring-shaped bead on the base part of the round plug comes to rest against this plug boundary edge so the depth to which the round plug can be inserted into the compartment is limited in this way.

In addition, there are also known locking attachments for plugs in which a locking element in the housing compartment catches behind an edge on the plug.

The known means for additional locking of an electric plug, such as a flat spring plug, are not suitable for round plugs because their location is not fixed with regard to their longitudinal axis when the plugs are plugged in, i.e., they may also be rotated about the longitudinal axis while plugged in.

SUMMARY OF THE INVENTION

The purpose of this invention is to provide an additional locking element for round plugs which can be shaped with simple means when the plug is produced.

This invention will be illustrated in greater detail with reference to the examples illustrated in the accompanying figures.

DESCRIPTION OF PREFERRED EMBODIMENT

Figure 1:
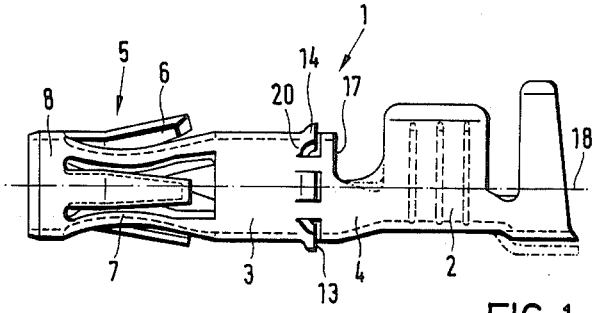
FIG. 1 shows a side view of a round plug receptacle.

A round plug receptacle (1) usually consists of a prong part (2) at the rear which is connected by a bridge (4) to a base part (3) which has a rolled cylindrical shape in the cross section. The contact area (5) extends forward from the base part (3). In the contact area (5) there are stop spring arms (6) which project outward to the rear in a known manner. Between the stop spring arms and approximately parallel with them there are contact spring arms (7) which end in a contact ring (8) connected to the base part 3 by way of the contact spring arms 7.

Figure 3:
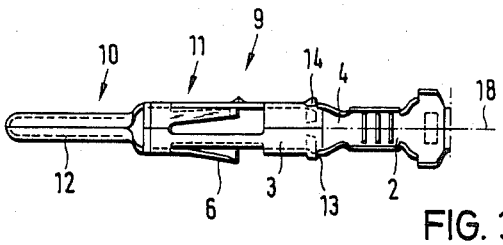
FIG. 3. A top view of a round plug.

A round plug (9) is designed accordingly (FIG. 3). Its prong part (2) is connected to the base part (3) by a bridge (4) to which the contact plug area (10) is connected. The contact plug area (10) consists of a contact area (11) and the plug pin (12). Stop spring arms (6) which project outward to the rear are located in the contact area (11) in a known way.

This invention proposes that a stop edge should be provided as an additional locking element in the casing of the cylindrical rolled base part (3) so that it runs across the longitudinal axis of the round plug and projects radially outward beyond the base part (3).

The stop edge is preferably located on an imaginary circle such that the diameter of the circle is larger than the outside diameter of the cylindrical rolled base part (3).

According to a particular embodiment of this invention, several short stop edges (13) are distributed on the imaginary circle and located on gaps, so that preferably the length of one gap is smaller than the length of one stop edge (13) and the ratio of these lengths is 1:1.4 to 1:1.8. Preferably, the stop edges (13) take up more than 50% of the circumference of the imaginary circle.

Preferably, at least six stop edges (13) of equal length are distributed uniformly on the imaginary circle, but each stop edge is straight, i.e., there is no curvature with respect to the radius of curvature of the imaginary circle.

According to the particular embodiment of this invention, the stop edges (13) are formed by fins (14) cut in the casing of the base part (3). The fins (14) are preferably formed by a U-shaped cut with the cut edges (15 and 16) running parallel to each other and parallel with the longitudinal axis (18), and with the cut edge (19) running parallel with the rear edge (17) of the base part (3) and across the longitudinal axis (18) of the cut edge (19), in which case the cut edge (19) is located at the rear with respect to the cut edges (15 and 16). Such a U-shaped cut results in a rectangular fin (14) which is still connected at its base (20) to the base part (3). The fin (14) is bent outward in the base (20) to assure the function of the stop edge (13) and preferably is bent back following that approximately in the area (21) so that it runs parallel to the casing surface again.

Figure 2:
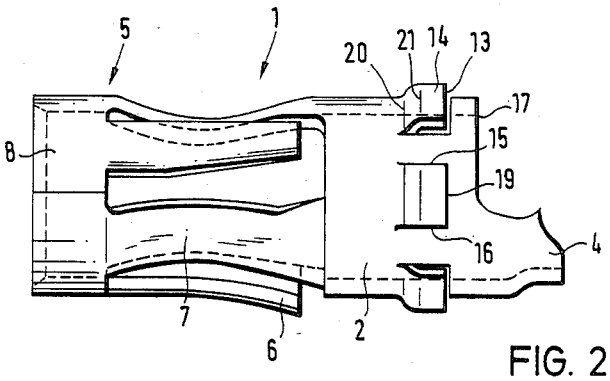
FIG. 2 shows an enlarged side view of part of the round plug receptacle.

The illustrations shown in FIGS. 1 to 3 demonstrate the preferred arrangement of the fins (14) within the casing of the base part. It may also be expedient, however, to position the cuts (15 and 16) in the vicinity of the rear edge (17) of the base part (3) so that these cuts can end at the rear edge and the cut (19) can be eliminated. In this case, the area of the rear edge (17) which results from the cuts (15 and 16) forms the stop edge (13).

Figure 4:
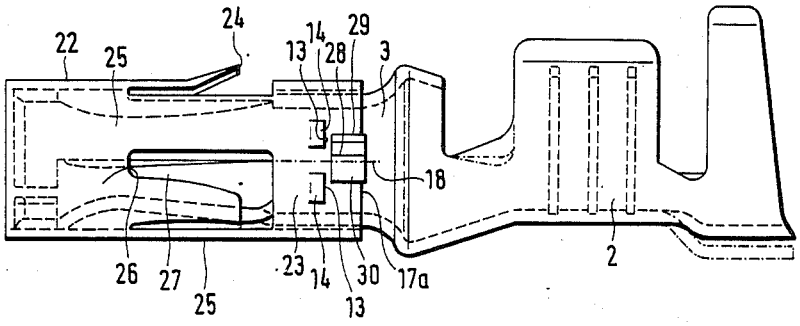
FIG. 4. A side view of the round plug receptacle with overtravel.

If the round plug (1) is provided with overtravel (22) (FIG. 4) and the overtravel (22) has a cylindrical rolled base part (23) with a rear edge (**17*a*) which rests with a positive fit against the base part (3) of the round plug (1) and optionally also has stop spring arms (24) as well as connecting bridges (25) and a receptacle part (26) in front of the base part (23), and gaps (27) are provided between the stop spring arms (24) and the connecting bridges (25), then it may be advantageous according to another embodiment of this invention to position the stop edges (13) or the fins (14) in the base part (23) of the overtravel (22) in accordance with the round plugs (1, 9) without overtravel (FIG. 4). The overtravel (22**) may have a securing fin (28) which is bent inward around the line or curvature (29) and engages an aperture (30) in the base part (3).

The additional locking elements (13, 14) according to this invention may work together with stop spring tongues (not shown) that are positioned accordingly in one housing chamber in a known manner by having the stop spring tongues catch behind the stop edges.

I claim:

1. A round plug intended for retained insertion in a housing, said plug comprising:

a rolled base member including a casing with a cylindrical shape in cross section;

a contact area connected to said casing and extending forwardly toward the front of the plug;

a prong part extending rearwardly from said casing toward the rear of the plug;

stop spring arms in said contact area for engaging a certain part of the housing into which the plug is inserted;

additional locking elements comprising a plurality of fins cut into the casing of the base member rearwardly from said prong part;

said fins having a base end connected to the casing and extending rearwardly from the base end to a cut edge displaced radially outwardly from the casing, said cut edges of the fins comprising stop surfaces;

said stop surfaces being located on an imaginary plane defined by a circle concentric with the longitudinal axis of the plug and having a diameter larger than the outside diameter of the base member;

said outwardly-displaced stop surfaces being of equal circumferential length and distributed with uniform angular spacing around the periphery base member with gaps interposed between adjacent stop surfaces; and said stop surfaces being straight with respect to the radius of the imaginary plane, whereby said stop surfaces of the fins cooperate for locking engagement with a mating locking element in the housing for the plug.

2. The plug according to claim 1, wherein the two cut edges end at the rear edge of the base member, and the third cut edge comprises said rear edge.

3. The plug according to claim 1, wherein the round plug is equipped with an overtravel portion comprising a cylindrical rolled base part with a rear edge which fits the shape of said base member of the round plug, and said additional locking elements are positioned on the overtravel portion.

4. The plug according to claim 1, wherein the circumferential length of each gap is smaller than the circumferential length of each stop edge.

5. The plug according to claim 4, wherein the ratio of said lengths of gaps to stop edges is in the range 1:1.4 to 1:1.8.

6. The plug according to claim 4, wherein the combined circumferential lengths of the stop edges is more than 50% of the circumference of said circle.

7. The plug according to claim 1, wherein each fin comprises a U-shaped cut with two cut edges running parallel to the longitudinal axis of the plug and parallel to each other, and with a third cut edge that runs across the longitudinal axis of the plug, said third cut edge located at the rear of the fin and defining said stop surface facing toward the rear of the plug.

8. The plug according to claim 7, wherein each fin which results from said cuts is rectangular and is connected at its base end to the base member of the plug and is bent outward at the base member, thereby projecting said stop surfaces outwardly from the casing of the base member.

9. The plug according to claim 8, wherein each fin is bent back along a bending line toward the casing so that the fin extending rearwardly from the bending line is parallel with the casing.

* * * * *